5/26/81 XR 4,268,985

United States Patent [19]

Lecznar

[11] 4,268,985

[45] May 26, 1981

[54] DESK NAME PLATE

[76] Inventor: Joseph F. Lecznar, 26837 Lyndon, Redford, Mich. 48239

[21] Appl. No.: 146,751

[22] Filed: May 5, 1980

Related U.S. Application Data

[63] Continuation-in-part of Ser. No. 912,425, Jun. 5, 1978, abandoned.

[51] Int. Cl.[3] ..... G09F 13/12

[52] U.S. Cl. ..... 40/219; 40/358; 40/584; 350/287

[58] Field of Search ..... 40/584, 10 D, 546, 559, 40/582, 358, 219; 350/287, 112, 113

[56] References Cited

U.S. PATENT DOCUMENTS

| | | | |
|---|---|---|---|
| T936,004 | 7/1975 | Willis | 350/112 |
| 1,546,146 | 7/1925 | Shaffer | 40/582 |
| 2,539,654 | 1/1951 | Barnes | 40/546 |
| 3,073,210 | 1/1963 | Packard | 350/112 |
| 3,364,603 | 1/1968 | Tate | 40/10 D |
| 3,722,459 | 3/1973 | Kisselmann et al. | 350/112 |
| 3,786,626 | 1/1974 | Hurt | 350/112 |
| 3,889,187 | 6/1975 | Kisselmann et al. | 350/112 |

FOREIGN PATENT DOCUMENTS

| | | | |
|---|---|---|---|
| 1016959 | 10/1957 | Fed. Rep. of Germany | 350/287 |
| 1098941 | 1/1968 | United Kingdom | 350/287 |

*Primary Examiner*—John F. Pitrelli
*Assistant Examiner*—G. Lee Skillington
*Attorney, Agent, or Firm*—Charles W. Chandler

[57] ABSTRACT

A name plate comprising a right angle glass prism mounted on a mirror such that an exhibit mounted on one of the prism faces provides several images depending upon the user's line of sight of the prism.

1 Claim, 6 Drawing Figures

DESK NAME PLATE

REFERENCE TO RELATED APPLICATION

This application is a continuation-in-part of application Ser. No. 912,425 filed June 5, 1979, now abandoned.

BACKGROUND OF THE INVENTION

This invention is related to name plates, and more particularly to a name plate in which a glass prism is mounted on a mirror having a mirrored surface spaced the thickness of the mirror from the bottom face of the prism. Several images of an exhibit on one face of the prism can be viewed through another prism face depending upon the direction of the user's line of sight and the prism.

SUMMARY OF THE INVENTION

The broad purpose of the present invention is to provide an improved name plate employing a glass prism mounted on a glass mirror to provide multiple images of an exhibit mounted on one face of the prism. One image is a reflection of the exhibit off the bottom face of the prism. As the viewer raises his line of sight, he views a second reflected image. Further raising of his line of sight will cause the first reflected image to fade out. If he raises his line of sight to a position generally perpendicular to the prism base, he will then view another, upside down, reflected image of the exhibit.

The second image is the result of the image being refracted through the thickness of the glass of the mirror while the first image is the result of the image being reflected off the bottom face of the prism. There is a transitory position of the viewer's line of sight when he views both images as one fades out and the other comes into view. This transitory state produces an apparent "ghost" image which provides an attention-getting feature of the name plate as a person passes the name plate.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
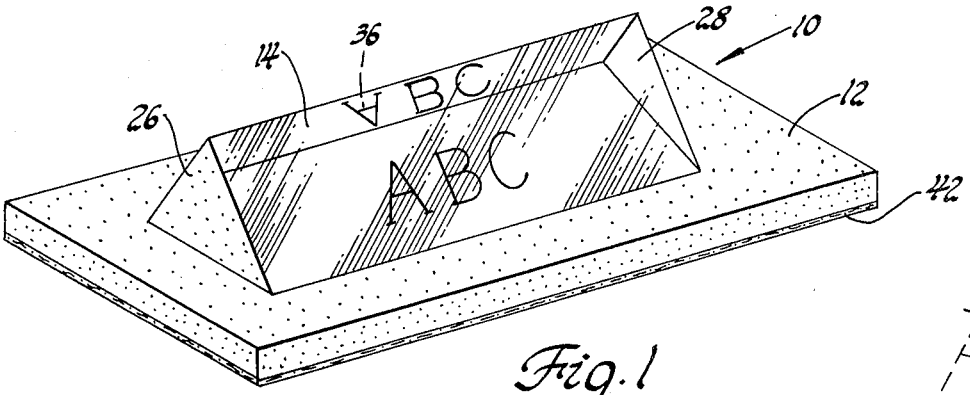
FIG. 1 is a perspective view of a name plate illustrating the preferred embodiment of the invention.

Referring to the drawing, a preferred name plate, generally indicated at 10, comprises a base 12 and a prism 14. Base 12 has a rectangular configuration with a flat upper surface 16 and a recessed, rectangular midsection 18. A mirror 20 is seated in recess 18.

Figure 2:
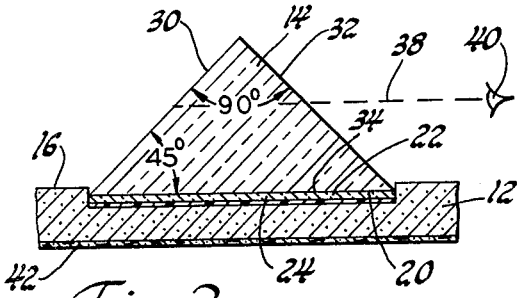
FIG. 2 is a sectional view of the name plate.

Referring to FIG. 2, mirror 20 is formed of a sheet of glass 22 having a reflective or mirrored coating 24. Mirrored coating 24 faces upwardly toward the prism and is on the bottom face of glass 20. The coating is spaced from prism 14 a distance corresponding to the thickness of glass 20.

Prism 14 is preferably of a prism glass and has a pair of end faces 26 and 28, a face 30 formed at a 90° angle with respect to face 32, and a 45° angle with respect to the bottom face 34.

Still referring to FIG. 2, an exhibit 36 comprises a series of letters etched into the surface of face 30. Faces 26, 28, and 30 are then coated with an opaque flat paint.

Exhibit 36 is observable through the prism by a line of sight 38 from the eye 40 of the viewer parallel to face 34.

Figure 3:
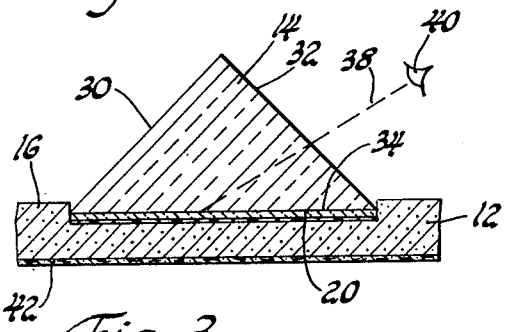

Referring to FIG. 3, as the viewer changes his line of sight 38 toward the bottom face of the prism, he will then view a reflected, upside down image of exhibit 36.

Figure 4:
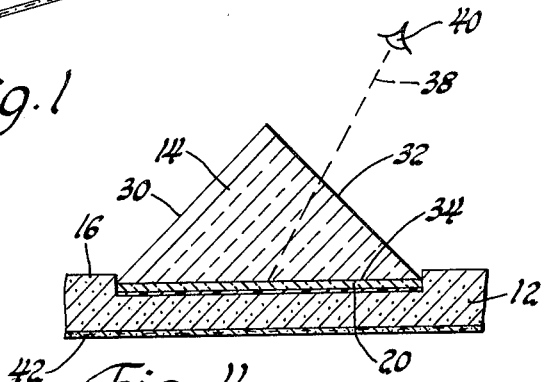
FIGS. 3, 4, and 5 are similar to FIG. 2. but showing different lines of sight of the viewer's eye.

Referring to FIG. 4, if the viewer then increases the angle between his line of sight and face 34, he will pass through a transistory state at which time he will view a double image caused by a portion of the exhibit's image being refracted through bottom face 34 of the prism into the mirror. This portion of the refracted image is reflected off mirrored surface 24. As he further increases the angle between his line of sight and bottom face 34 of the prism, he passes through a critical angle when the image reflected from the bottom face 34 of the prism fades out of sight and the refracted image, reflected off the mirror surface 24 of the mirror, comes into full view.

Figure 5:
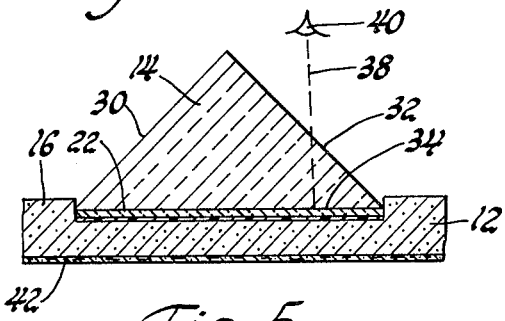
Figure 6:
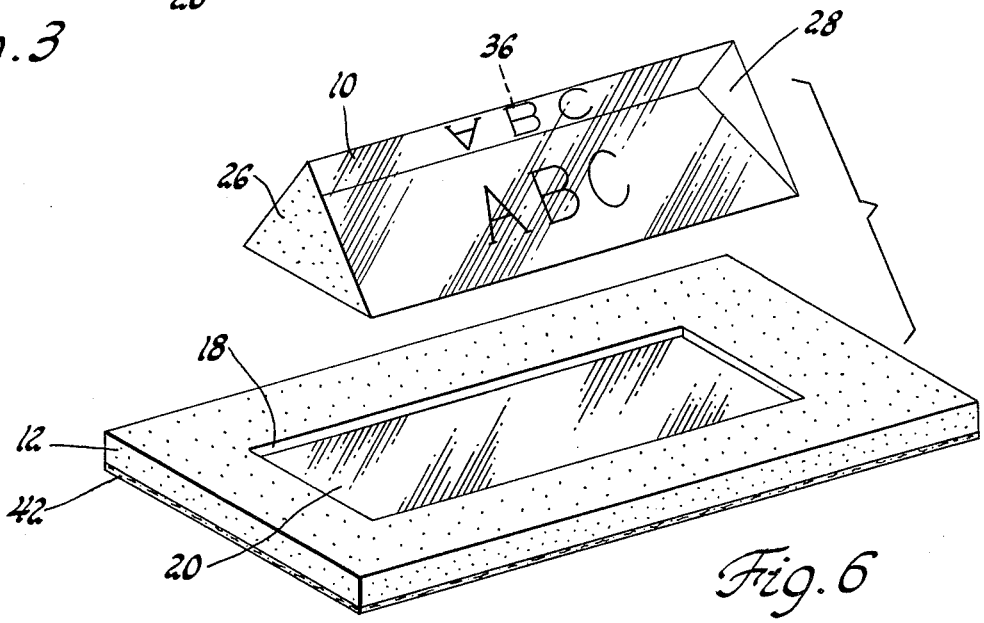
FIG. 6 is an exploded view of the preferred name plate.

If the viewer continues to raise his line of sight to that illustrated in FIG. 5 to a position generally perpendicular to the bottom face 34 of the prism, he will view another image of the exhibit, upside down with respect to the first and second images.

Thus depending upon the angle of the user's line of sight and the prism, he can view either the exhibit itself or three reflected images of the exhibit. As a person moves past the prism, the appearance of the different images as they come into and fade out of view attract his attention.

Preferably the prism is seated in the recessed midsection 18 so that it will not slide off the base as the viewer tilts the base upwardly.

A felt pad 42 is attached to the bottom of the base to prevent the base from scratching the surface of a desk (not shown) on which the name plate is disposed.

Having described my invention, I claim:

1. A desk name plate, comprising:

base means including a glass mirror having an upper surface and an upwardly facing reflective surface spaced beneath the upper surface a distance corresponding to the thickness of the mirror;

a glass prism having a first face, and a second face, and a third face, the first face being disposed at a 90° angle with respect to the second face and a 45° angle with respect to the third face, said prism being disposed such that the third face thereof is parallel to and adjacent the upper surface of the mirror; and an exhibit mounted on the first face of the prism so as to be viewable through the second face and to provide a first image and a second image of the exhibit, each of said images being viewable through the second face, the first image being upside down with respect to the exhibit and comprising a reflection of the exhibit from the third face of the prism, and the second image being right side up with respect to the exhibit and comprising a reflection of the exhibit from the reflective surface of the mirror.

* * * * *